United States Patent [19]

Ota et al.

[11] 3,954,090

[45] May 4, 1976

[54] IGNITION TIMING CONTROL DEVICES FOR ENGINES

[75] Inventors: Nobuyoshi Ota, Kariya; Hiroyuki Masuda, Aichi; Kiyohiko Mizuno, Nagoya, all of Japan

[73] Assignee: Nippondenso Co., Ltd., Kariya, Japan

[22] Filed: Oct. 2, 1973

[21] Appl. No.: 402,777

[30] Foreign Application Priority Data

| | | |
|---|---|---|
| Oct. 3, 1972 | Japan | 47-11530[U] |
| Nov. 17, 1972 | Japan | 47-133003[U] |
| Jan. 18, 1973 | Japan | 48-8942[U] |
| Jan. 18, 1973 | Japan | 48-8943[U] |
| Aug. 24, 1973 | Japan | 48-95406 |

[52] U.S. Cl. ..... 123/117 A; 123/146.5 A

[51] Int. Cl.[2] ..... F02P 5/04

[58] Field of Search ..... 123/117 R, 117 A, 146.5 A

[56] References Cited

UNITED STATES PATENTS

| | | | |
|---|---|---|---|
| 2,876,754 | 3/1959 | Obermaier | 123/117 A |
| 3,521,610 | 7/1970 | Coudriet | 123/117 A |
| 3,680,533 | 8/1972 | Soberski | 123/117 A X |
| 3,789,811 | 2/1974 | Franz et al. | 123/117 A |
| 3,800,759 | 4/1974 | Cedar | 123/117 A |
| 3,810,451 | 5/1974 | Fales | 123/117 A |
| 3,812,832 | 5/1974 | Scott | 123/117 A |
| 3,841,515 | 10/1974 | Ota | 123/117 A |

*Primary Examiner*—Charles J. Myhre
*Assistant Examiner*—Paul Devinsky
*Attorney, Agent, or Firm*—Cushman, Darby & Cushman

[57] ABSTRACT

An ignition timing control device comprising a vacuum advance mechanism of the type controlling the ignition timing in response to the negative pressure in a carburetor, a negative pressure line between the carburetor and the vacuum advance mechanism, and a thermostatic valve for opening the negative pressure line to the surrounding atmosphere only when the temperature of an engine is within a predetermined temperature range.

6 Claims, 16 Drawing Figures

IGNITION TIMING CONTROL DEVICES FOR ENGINES

BACKGROUND OF THE INVENTION

The present invention relates to generally an igntion timing control device for an engine and more particularly an ignition timing control device of the type which automatically controls the ignition timing such that the emission of pollutants such as nitrogen oxides (NOx) and unburned hydrocarbon (HC) is decreased only when the temperature of the engine is within a predetermined temperature range.

It has been well known that the retardation of ignition timing can effectively reduce the emission of pollutants such as nitrogen oxides and hydrocarbons. In order to retard the ignition timing, there has been proposed a method for opening a negative pressure line between a vacuum advance mechanism of a distributor and a carburetor to the surrounding atmosphere. However this method has defects in that the automotive engine output drops when the engine temperature is low and the engine becomes overheated when the load is increased. It is well known that the emission of nitrogen oxides is relatively low when the engine temperature and hence the engine output are low. It is therefore preferable to activate a vacuum advance mechanism until the engine temperature rises to such a level that sufficient output may be obtained and to deactivate the vacuum advance mechanism when the engine temperature rises to such a point that a large quantity of nitrogen oxides is produced and discharged. Furthermore it is clear that the overheating of an engine due to the deactivation of the vacuum advance mechanism may be prevented when the vacuum advance mechanism is activated again.

SUMMARY OF THE INVENTION

In view of the above, one of the objects of the present invention is to provide an ignition timing control device of the type in which a thermostatic valve, which is actuated at a minimum temperature (to be referred to as a lower setting temperature or point in this specification) of an engine for producing a sufficient output and also at a temperature (to be referred to as a higher setting temperature or point in this specification) immediately below a temperature at which the engine is overheated, is inserted in a negative pressure line between a vacuum advance mechanism and a carburetor so that only when the engine temperature is between the lower and higher setting points is the thermostatic valve opened to communicate the vacuum advance mechanism with the surrounding atmosphere, thereby deactivating the operation thereof.

Another object of the present invention is to provide an ignition timing control device comprising a thermostatic valve adapted to communicate a vacuum advance mechanism with the surrounding atmosphere only when the engine temperature is within a predetermined range so that the emission of pollutants may be reduced without the engine operation being adversely affected.

A further object of the present invention is to provide a thermostatic valve which is simple in construction and reliable in operation and which may be inserted in a simple manner into a negative pressure line between a vacuum advance mechanism and a carburetor.

A still further object of the present invention is to provide a thermostatic valve which may be incorporated in a simple manner into a vacuum advance circuit of an ignition timing control device of an existing automobile vehicle.

The above and other objects, features and advantages of the present invention will become more apparent from the following description of preferred embodiments thereof taken in conjunction with the accompanying drawings.

DESCRIPTION OF THE PREFERRED EMBODIMENTS

First Embodiment, FIGS. 1–6

Figure 1:
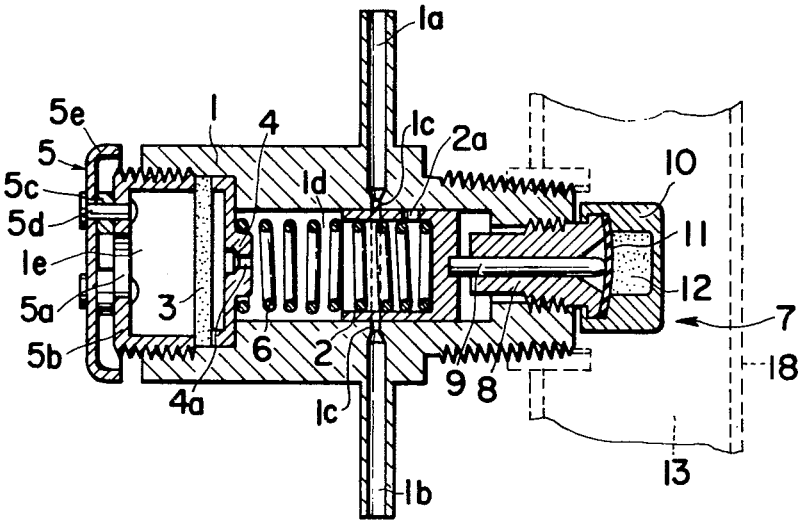
FIG. 1 is a sectional view of a first embodiment of a thermostatic valve incorporated into an ignition timing control device of the present invention.

FIG. 1 illustrates in section a first embodiment of a thermostatic valve in accordance with the present invention. A casing 1 has a bore 1*d*, a negative pressure input port 1*a* and an output port 1*b*. The input and output ports 1*a* and 1*b* are opened into an annular groove 1*c* formed in the inner wall of the bore 1*d* so as to be normally communicated with each other. A cup-shaped spool 2 having a port 2*a* formed through the side wall thereof is slidably fitted into the bore 1*d* and is loaded with a spring 6. When the port 2*a* of the spool 2 coincides with the annular groove 1*c*, the input and output ports 1*a* and 1*b* are communicated through a port 4*a* of an air nozzle plate 4 and an air filter 3 with an air chamber 1*e* at the left end of the casing 1 which communicates with the surrounding atmosphere. In order to keep the chamber 1*e* free from water and foreign matters, a cover assembly generally indicated by 5 is screwed into the chamber 1*e*. The cover assembly 5 generally comprises an externally threaded cap 5*b* screwed into the chamber 1*e* and provided with an opening 5*a*, and a cover 5*e* fixed to the cap 5*b* with rivets 5*d* and spaced apart therefrom by spacers 5*c* fitted over the rivets 5*d*. It is seen that the cap 5*b* serves to hold the air filter 3 and the air nozzle plate 4 in position.

Figure 2:
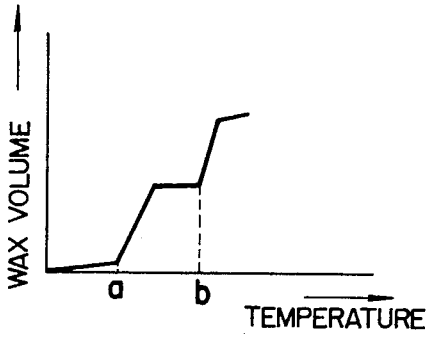
FIG. 2 is a graph illustrating the relation between the temperature and the thermal expansion of waxes used in the thermostatic valves in accordance with the present invention.

A temperature detector generally indicated by 7 and screwed into the casing 1 comprises an externally threaded cylinder 8, a piston 9 slidably fitted into the cylinder and fixed to the spool 2 and to a diaphragm 11 disposed at the outer end of the cylinder 8, and a cover 10 fitted over the cylinder 8. Within the cover 10 is therefore defined a thermal expansion chamber 12 by the diaphragm 11. The chamber 12 is filled with a substance having a special thermal expansion property. The temperature detector 7 is placed within an engine cooling water passage 13 so as to detect the temperature of the engine. The substance contained in the chamber 12 preferably consists of a mixture of two kinds of wax having different melting points from each other. Each wax may be mixed with powdered copper so as to increase its thermal conductivity. The melting point of one wax having a low melting point determines a lower setting temperature *a* whereas the melting point of the other wax has a higher melting point at a higher setting temperature *b*. It is to be understood that such wax mixture is suddenly expanded at the lower and higher setting temperatures *a* and *b* because the a wax having a lower melting point is melted into liquid to suddenly increase its volume at the temperature *a* and the other wax having a higher melting point is melted at the temperature *b*. This expansion progress is shown in FIG. 2 and will be hereinafter called the "two-step thermal expansion property" in this specification.

Next the mode of operation of the thermostatic valve with the above construction will be described. When the temperature of cooling water is less than the lower setting point *a*, the side port 2*a* of the spool 2 is closed by the inner wall of the bore 1*d* so that the input port 1*a* is communicated through the annular groove 1*c* with the output port 1*b*. The negative pressure or vacuum transmitted through the imput port 1*a*, the annular groove 1*c* and the output port 1*b* is not affected by the atmospheric pressure. As the temperature of cooling water approaches and exceeds the lower setting point *a*, wax with a lower melting point is melted and increased in volume. As a result the diaphragm 11 is moved toward the left so that the spool 2 is also moved to the left and its side port 2*a* coincides with the annular groove 1*c*. As a consequence, the atmosphere pressure is transmitted to the input and output ports 1*a* and 1*b* through the opening 5*a* of the cap 5*b*, the chamber 1*e*, the air filter 3, the air nozzle plate 4, the bore 1*d*, the side port 2*a* and the annular groove 1*c*. When the temperature of cooling water is further increased to and beyond the higher setting temperature *b*, wax with a higher melting point is melted and is increased in volume so that the spool 2 is further moved to the left and the side port 2*a* is moved away from the annular groove 1*c* and closed by the inner wall of the bore 1*d*. As a result the input and output ports 1*a* and 1*b* communicated with each other through the annular goove 1*c* are isolated from the atmospheric pressure.

Figure 3:
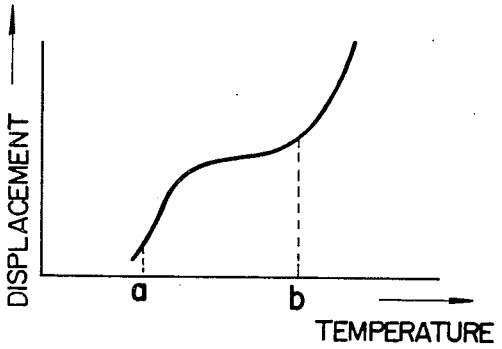
FIG. 3 is a graph illustrating the relation between the temperature and the displacement of a valve element of the thermostatic valve shown in FIG. 1.
Figure 4:
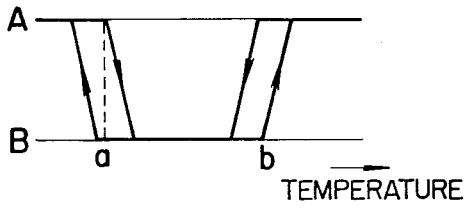
FIG. 4 is a graph illustrating the relation between the temperature and the establishment and interruption of the the communication between an input port and an output port of the thermostatic valve shown in FIG. 1.

FIG. 3 shows the relation between the temperature and the displacement of the spool 2, and FIG. 4 shows the communication between the input and output ports 1*a* and 1*b* and the air chamber 1*e*. The line A denotes that the input and output ports 1*a* and 1*b* are not communicated with the air chamber 1*e* while the line B denotes that they are communicated with the air chamber 1*e*.

Next the ignition timing control device incorporating the thermostatic valve of the type described will be explained hereinafter. In a vacuum advance mechanism of the type in which the ignition advance is controlled in response to the temperature of cooling water in order to reduce the emission of nitrogen oxides, the ignition retardation is not necessary when the temperature of cooling water is about less than 60°C because the emission of nitrogen oxides is less at relatively low temperatures of the engine and because the decrease in output of the engine must prevented. Furthermore when the ignition is retarded at a constant rate even after the temperature of cooling water exceeds 60°C, the engine would be overheated when the load is increased. It is therefore necessary to interrupt the ignition retardation after the temperature of cooling water exceeds 95° or 100° C. The igntion timing control device in accordance with the present invention is best suited for accomplishing the above controls.

Figure 5:
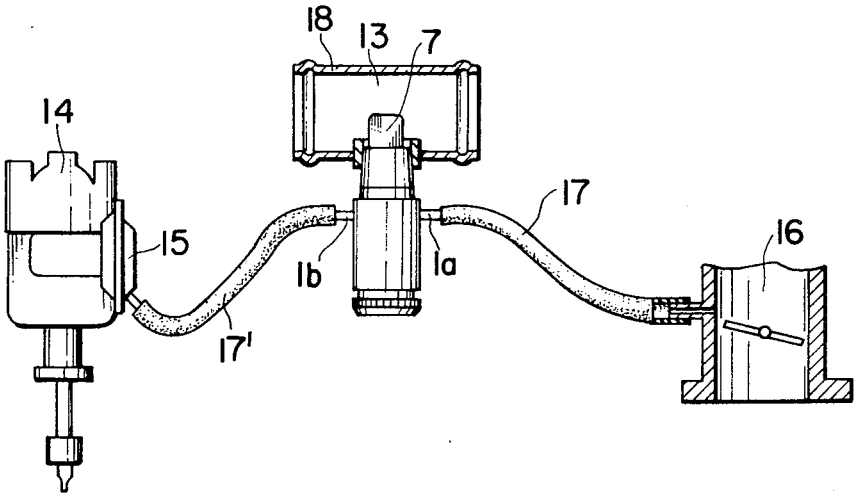
FIG. 5 is a schematic diagram of an ignition timing control device in accordance with the present invention incorporating the thermostatic valve shown in FIG. 1.
Figure 6:
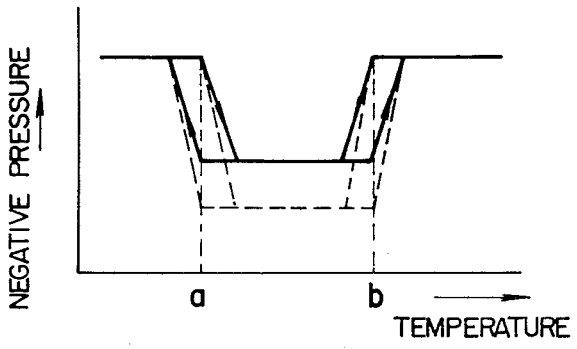
FIG. 6 is a graph illustrating the relation between the temperature and the negative pressure acting upon the vacuum advance mechanism.

Referring to FIG. 5, the thermostatic valve is fixed to a pipe section 18 inserted into an upper hose of a radiator in such a manner that the temperature detector 7 of the valve may be placed into cooling water 13 flowing through the upper hose from the cylinder head to the radiator. The output port 1*b* is hydraulically connected to a vacuum advance mechanism 15 of a distributor 14 through a distributor line 17', whereas the input port 1*a* is hydraulically connected to a carburetor 16 through a vacuum line 17. In the instant embodiment, the lower setting temperature *a* is 60° C whereas the higher setting temperature *b* is 95° or 100° C. The negative pressure versus temperature characteristics in the output port 1*b* are shown in FIG. 6. It is seen that the vacuum or negative pressure in the carburetor 16 is transmitted to the vacuum advance mechanism 15 only when the temperature of cooling water is less than 60° C or in excess of 95° or 100° C, and the atmospheric pressure acts upon the vacuum advance mechanism 15 when the temperature is between 60° and 95° or 100° C so that the vacuum advancement is decreased. As a result the reduction of the emission of nitrogen oxides can be attained under the normal traveling condition without causing the decrease in output of the engine at a low temperature and the overheating of the engine under an increased load. The pressure acting upon the vacuum advance mechanism 15 when the input and output ports 1*a* and 1*b* are communicated with the surrounding atmosphere is dependent upon the flow rate of air passing through the port 4*a* of the air nozzle plate 4 into the carburetor 16. Therefore the vacuum or negative pressure acting upon the vacuum advance mechanism 15 may be adjusted by adjusting the diameter of the port 4*a* and hence the flow rate of air passing therethrough. For example when the diameter of the port 4*a* is increased the flow rate is also increased in proportion so that the negative pressure is reduced as indicated by the broken characteristic curve in FIG. 6. As described hereinbefore the negative pressure acting upon the vacuum advance mechanism 15 between the lower and higher setting temperatures may be arbitarily selected. Therefore the ignition timing may be so controlled that the excessive decrease in output of engine may be prevented. It will be understood that the negative pressure acting upon the vacuum advance mechanism 15 may be also adjusted by placing an orifice in a line connecting to the input port 1*a*.

In the instant embodiment the thermostatic valve actuated in response to the thermal expansion of a substance is used, but it will be understood that a solenoid controlled valve actuated in response to the signal from a thermostatic switch may be used instead of the thermostatic valve.

According to the present invention, the thermostatic valve incorporates the temperature detector of the type detecting the temperature as a function of thermal expansion of mixed wax so that the ignition timing control device does not require any other component part. Therefore the cost is inexpensive and the installation even into the exsisting automotive engines is very simple.

Figure 7:
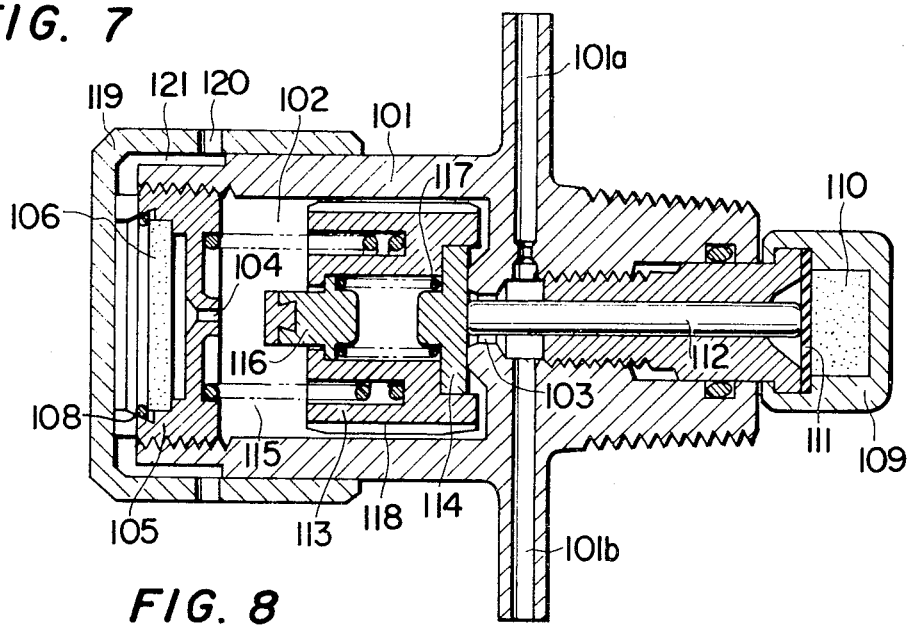
FIG. 7 is a sectional view of a second embodiment of the thermostatic valve.
Figure 8:
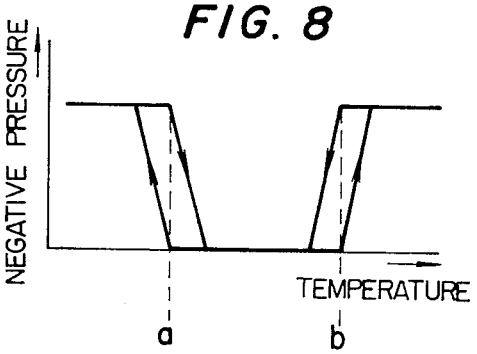
FIG. 8 is a graph illustrating the relation between the temperature and the negative pressure acting at an output port of the thermostatic valve shown in FIG. 7.

Second Embodiment, FIGS. 7 and 8

The second embodiment of a thermostatic valve in accordance with the present invention shown in FIG. 7 is substantially similar in construction to the first embodiment shown in FIG. 1 except the construction of the spool. A casing 101 has an input 101*a* and an output port 101*b* which are communicated with a bore 102 through an opening 103. A bottom plate 105 having a central port 104 is screwed into one end of the casing 101, and a porous filter disk 106 is removably fitted into a recess formed in the bottom plate 105 and securely held in position by means of a ring pin 108.

To the other end of the casing 101 is fixed a temperature detector generally indicated by 109 and similar in construction to the temperature detector shown in FIG. 1. A thermal expansion chamber 110 is filled with a mixture of wax of the type described with reference to the first embodiment. An elastic membrane such as a rubber membrane 111 which defines the wax chamber 110 is made into contact with one end of a piston 112 the other end of which extends through the opening 103 to make contact with a guide plate 114 of a valve element 113. The guide plate 114 is loaded with a spring 115 so as to close the opening 103 when the temperature detected by the temperature detector 109 is less than the lower setting temperature. An additional valve element 116 movably fitted into a bore of the valve element 113 and loaded with a spring 117 extends beyond the end of the valve element 113 opposite to the guide plate 114. At the lower setting temperature the piston 112 pushes the guide plate 114 due to the thermal expansion of wax in the chamber 110, and at the higher setting temperature the valve element 116 closes the port 104. When the temperature further rises in excess of the higher setting temperature, the piston 112 further pushes the guide plate 114 and hence the valve element 113 while the valve 116 closes the port 104 and compresses the spring 117. The valve element 113 is provided with a plurality of grooves 118 on the periphery thereof which serve as air passages. A cap member 119 fitted over the casing 101 and made of rubber or the like is provided with a plurality of air ports 120 formed through the side wall thereof, so that air may flow toward the filter 106 through the ports 120 and an annular passage 121 defined between the casing 101 and the cap member 119.

Next the mode of operation will be described. When the temperature detected by the temperature detector 109 is less than the lower setting point *a*, the guide plate 114, and the valve elements 113 and 116 are in the position shown in FIG. 7 so that the input and output ports 101*a* and 101*b* are communicated with each other but are isolated from the surrounding atmosphere. When the detected temperature approaches the lower setting temperature *a*, wax with a lower melting point in the wax chamber 110 is melted and expanded in volume so that the elastic membrane 111 pushes the piston 112 to the left. As a result the valve element 113, the guide plate 114 and the valve element 116 are moved in unison to the left away from the opening 103. As a result the input and output ports 101*a* and 101*b* are communicated with the surrounding atmosphere through the ports 120 of the cap member 119, the annular passage 121, the air filter 106, the port 104, the grooves 118 and the opening 103. When the temperature further rises beyond the higher setting temperature *b*, wax with a higher melting point is melted so that the wax mixture in the wax chamber 110 further expands in volume. The piston 112 pushes the guide plate 114 and hence the valve element 113 so that the valve element 116 is pressed against the port 104 to close it. As a result the communication of the input and output ports 101*a* and 101*b* with the surrounding atmosphere is interrupted.

FIG. 8 shows the negative pressure vs. temperature characteristics in the output 101*b* when the lower setting temperature is 60° C and the higher setting temperature is 95° or 100° C.

Third Embodiment, FIGS. 9–12

Figure 9:
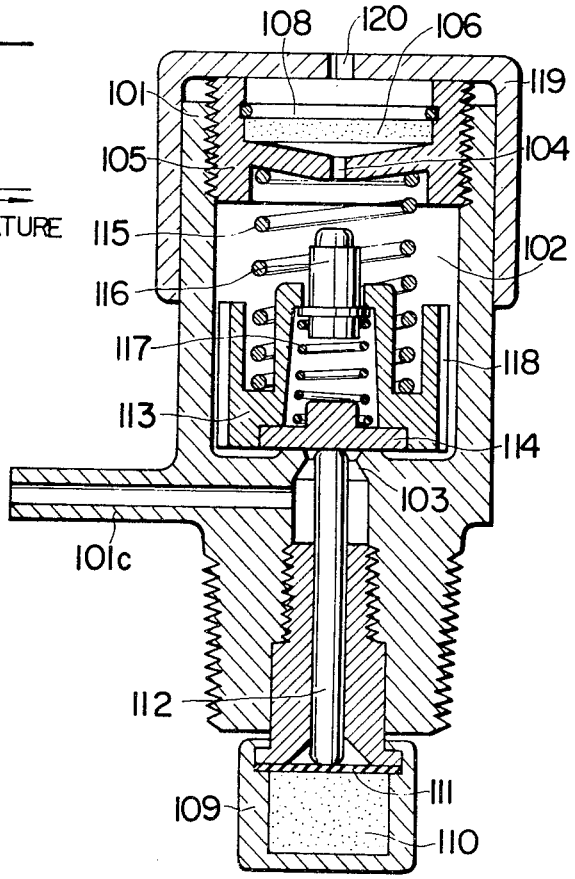
FIG. 9 is a sectional view of a third embodiment of the thermostatic valve.
Figure 10:
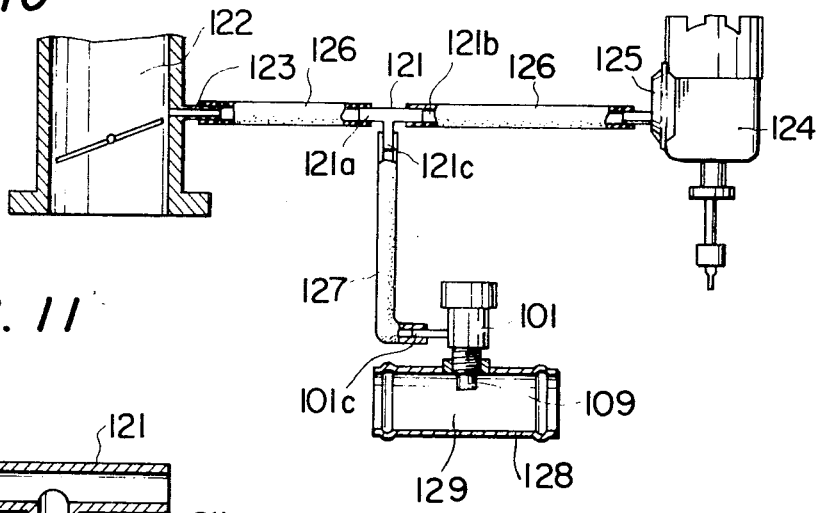
FIG. 10 is a schematic diagram of an ignition timing control device in accordance with the present invention incorporating the thermostatic valve shown in FIG. 9.
Figure 11:
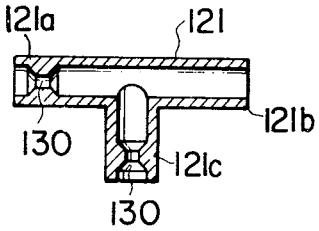
FIG. 11 is a sectional view of a tee member used in the negative pressure line shown in FIG. 10.

The third embodiment shown in FIG. 9 is substantially similar in construction to the second embodiment shown in FIG. 7 except that only one port 101*c* is communicated with the opening 103. This thermostatic valve is attached to a vacuum advance circuit as shown in FIG. 10. That is, a tee member 121 is inserted into a vacuum line 126 between a vacuum advance mechanism 125 of a distributor 124 and an advancer port 123 of a carburetor 122. A first end 121a of the tee member 121 is communicated through the vacuum line 126 with the advancer port 123, a second end 121*b*, with the vacuum advance mechanism 125 through the vacuum line 126, and a third end is communicated through a thermostatic valve line 127 with the port 101*c* of the thermostatic valve which is fixed to a pipe 128 inserted into an upper hose of a radiator in such a manner that the temperature detector 109 thereof may be placed in cooling water flowing through the upper hose. As shown in FIG. 11, orifices 130 are placed within the tee member 121 in order to limit the flow rate of air flowing into the carburetor when the thermostatic valve is opened.

Figure 12:
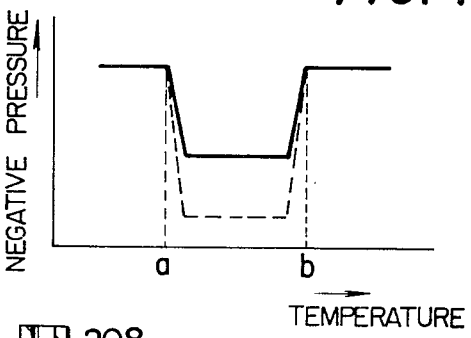
FIG. 12 is a graph illustrating the relation between the temperature and the negative pressure acting upon the vacuum advance mechanism in the control device shown in FIG. 10.

FIG. 12 shows the relation between the negative pressure acting on the vacuum advance mechanism 125 and the temperature of cooling water when the thermostatic valve of this embodiment is used. It is seen that between the lower setting temperature *a* and the higher setting temperature *b* the negative pressure is decreased. Within this range the negative pressure acting upon the vacuum advance mechanism is dependent upon the flow rate of air flowing through the thermostatic valve which in turn is suitably selected by selecting the dimensions of the orifices 130, the opening 103, the grooves 118. Therefore the negative pressure acting upon the vacuum advance mechanism 125 within the temperature range between *a* and *b* may be so controlled that the excessive drop of engine output may be prevented.

Fourth Embodiment, FIGS. 13–16

In the first, second and third embodiments described hereinbefore, the input port and hence the carburetor is also communicated with the surrounding atmosphere when the outlet port is communicated with the surrounding atmosphere, but in the fourth embodiment to be described with reference to FIGS. 13–16 hereinafter only the output port is communicated with the atmopshere so that the clogging of the input port and the input line due to the foreign matters entrained by air may be prevented.

Figure 13:
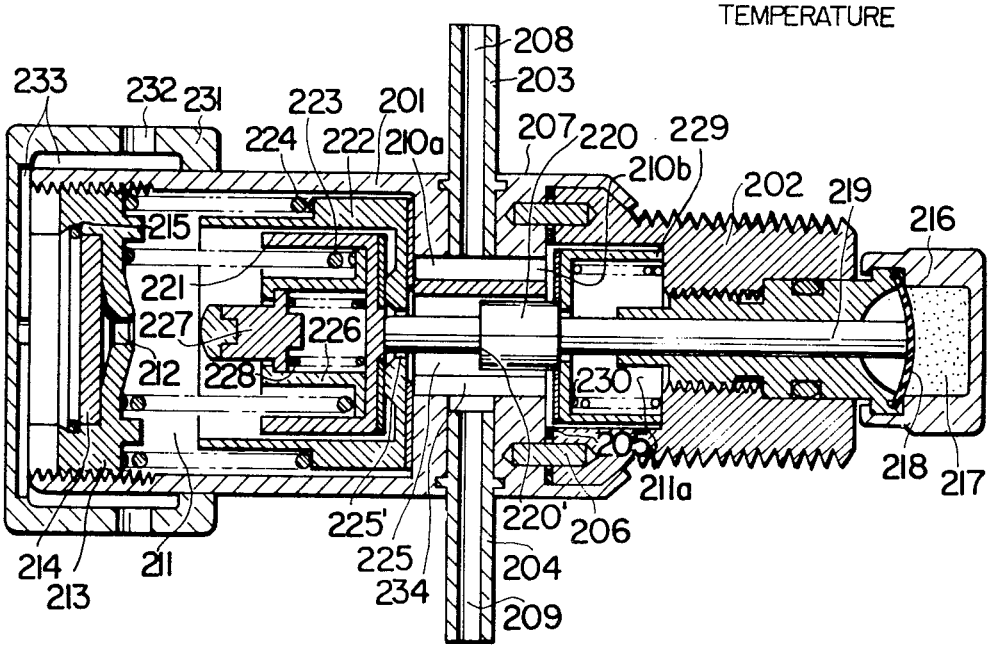
FIGS. 13, 14 and 15 are sectional views of a fourth embodiment of a thermostatic valve of the present invention, FIG. 13 showing the positions of the valve elements when the temperature of engine cooling water is lower than a lower setting point, FIG. 14 showing those when the temperature is higher than a lower setting point but lower than a higher setting point, and FIG. 15 showing those when the temperature is higher than a higher setting point.

Referring to FIG. 13, a thermostatic valve generally indicated by 207 comprises valve casings 201 and 202 assembled together with packings 205 and pins 206. The casing 201 has two pipes 203 and 204 which define an input port 208 and an output port 209, respectively. The input port 208 is communicated with inlet ports 210*a* and 210*b* to a first bore 211*a* and a second bore 211, respectively. A bottom plate 213 having a center port 212 is screwed into the open end of the second bore 211, and a porous filter disk 214 is removably fitted into a recess formed in the bottom plate 213 and held in position by a ring pin 215. A temperature detector 216 attached to the casing 202 is similar in construction to those of the aforementioned embodiments. It has a wax chamber 217 defined by an elastic membrane 218 and a piston 219.

A driving member 220 having a stem projecting forwardly is slidably fitted into a small diameter bore 225 formed in the case 201, and extends between the first and second bores 211*a* and 211 and is adapted to be pushed by the piston 219 as the wax mixture in the wax chamber 217 expands. A cup-shaped second valve element 222 having a center opening 225′ is slidably fitted into the second bore 211 and loaded with a spring 224, and a cup-shaped third valve element 221 is slidably fitted into the second valve element 222 and loaded with a spring 223. The stem of the driving member 220 is inserted into the center opening 225′ of the second valve element 222 with a sufficient clearance. When the wax mixture expands in the wax chamber 217, the driving member 220 is pushed to the left by the piston 219 so that the stem pushes the third valve element 221 while the second valve element 222 remains stationary. When the driving member 220 is further pushed to the left, the shoulder 220′ of the driving member 220 makes into contact with the second valve element 222 and pushes the latter to the left.

When the temperature detected by the temperature detector 216 is less that the lower setting temperature, the second valve element 222 is pressed against the bottom of the second bore 211 to close the small diameter bore 225 under the force of the spring 224, and the third valve element 221 is pressed against the bottom of the second valve element 222 to close the center opening 225′ thereof under the force of the spring 223 as shown in FIG. 13.

A cup-shaped first valve element 229 is slidably fitted into the first bore 211*a* of the casing 202 and loaded with a spring 230. The first valve element 229 has a center opening formed through the bottom thereof, and the piston 219 is extended through this center opening. When the temperature is less than the lower setting temperature, the driving member 220 is pushed to the right under the force of the spring 223 as shown in FIG. 13. Therefore the input port 208 is communicated with the output port 209 through the inlet port 210*b*, the first bore 211*a* in the casing 202, the small diameter bore 225, and a passage 234 which is formed in the casing 201 in the axial direction so as to be communicated with both the small diameter bore 225 and the output port 209.

A cup-shaped support member 226 is fixed to the bottom of the third valve element 221, and a small valve element 227 is inserted into a center hole of the support member 226 and loaded with a spring 228 as in the case of the second and third embodiments. When the temperature exceeds the higher setting point, the third valve element 221 is pushed to the left by the stem of the driving member 220 against the spring 223 so that the small valve element 227 closes the port 212 of the bottom plate 213. When the third valve element 221 is further pushed to the left as the temperature rises, the valve element 227 remains closing the port 212 while compressing the spring 228.

When the temperature exceeds the higher setting point, the second valve 222 is pushed to the left by the shoulder 220′ of the driving member 220 while the opening 225′ is closed. As a result the input port 208 is communicated with the output port 209 through the inlet port 210*a*, the second bore 211, the small diameter bore 225 in the casing 201, and the passage 234.

A rubber cap member 231 fitted over the open end side of the casing 201 is similar in construction to those of the second and third embodiments, so that air may flow into the second bore 211 through a plurality of ports 232 of the cap member 231, an annular passage 233 defined between the cap member 231 and the casing 201, the filter 214 and the port 212 of the bottom plate 213.

Next the mode of operation will be described. The temperature detector 216 is placed into the cooling water flowing through the upper radiator hose as in the case of the first, second and third embodiments. When the temperature is less than the lower setting point *a*, the input port 208 is communicated with the output port 209 through the inlet port 210*b*, the first bore 211*a* in the casing 202, the small diameter bore 225 in the casing 201, and the passage 234 as shown in FIG. 13. Both the input and output ports 208 and 209 are isolated from the surrounding atmosphere as the second and third valve elements 222 and 221 close the small diameter bore 225 and the opening 225′, respectively.

Figure 14:
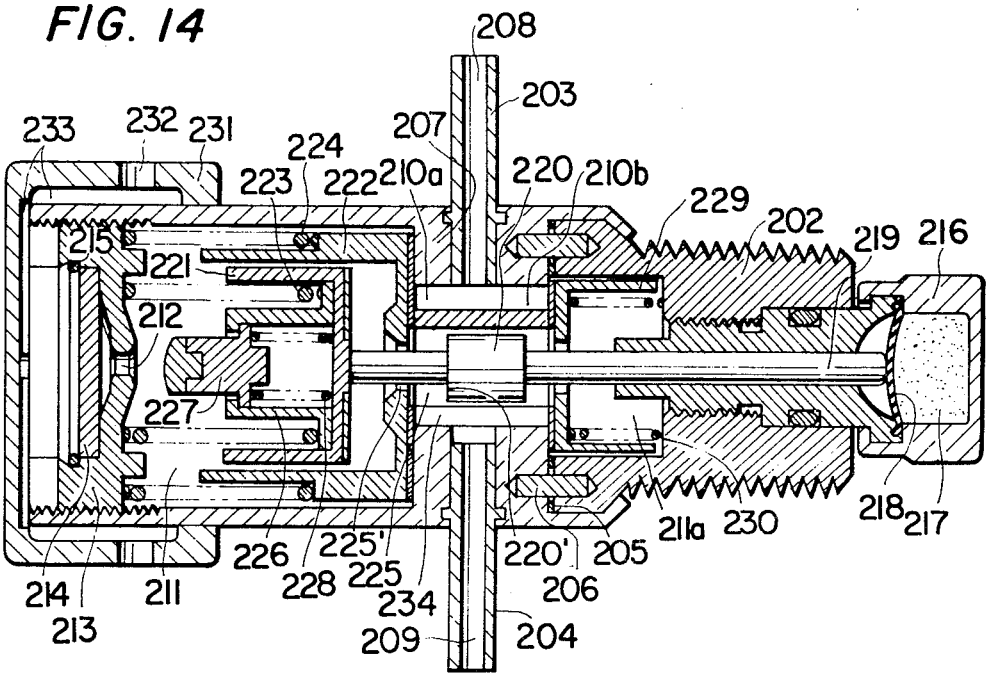

When the temperature of cooling water reaches the lower setting point *a*, wax with a lower melting point is melted and the wax mixture in the wax chamber 217 expands so that the elastic membrane 218 is displaced. As a result the piston 219 pushes the driving member 220 to the left against the spring 223 so that the third valve element 221 is pushed away from the bottom of the second valve element 222 as shown in FIG. 14. Therefore, the output port 209 is communicated with the surrounding atmosphere through the passage 234, the small diameter bore 225, the opening 225′ of the second valve element 222, the space between the second and third valve elements 222 and 221, the port 212 of the bottom plate 213, the air filter 214, the annular passage 233, and the ports 232. At this time, as the driving member 220 is pushed to the left away from the first valve element 229, the latter is pressed against the end of the casing 201 to close the inlet port 210*b* so that the communication of the input port 208 with the output port 209 is interrupted. Therefore, the pressure in the output port 209 is completely changed from the negative pressure in the carburetor to the atmospheric pressure.

Figure 15:
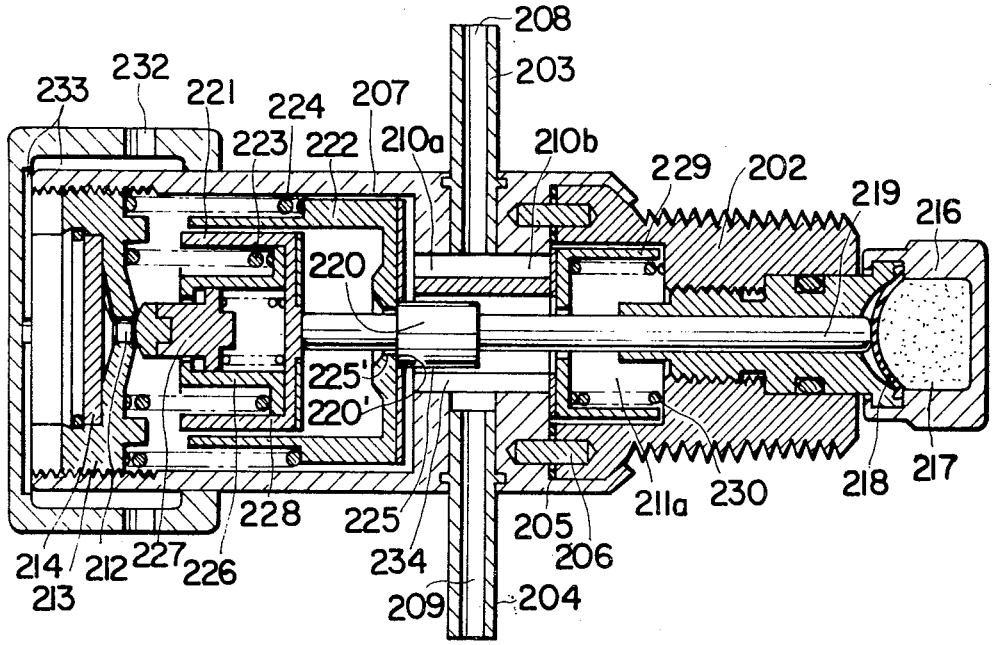

When the temperature of cooling water approaches the higher setting point *b*, wax with a higher melting point expands so that the piston 219 is futher displaced to the left. As a result, the driving member 220 is further displaced to the left so that the small valve element 227 closes the port 212 as shown in FIG. 15. At the same time, the shoulder 220′ of the driving member 220 is made into contact with the second valve element 222 to displace it to the left against the spring 224. Therefore the input port 208 is communicated with the output port 209 through the inlet port 210*a*, the second and small diameter bores 211 and 225 in the casing 201, and the passage 234. Therefore, the pressure in the output port 209 is completely changed from the atmospheric pressure to the negative pressure.

As described hereinbefore, in the fourth embodiment, the interruption of the communication between the port 212 and the output port 209, the establishment of the communication between the input port 208 and the output port 209, the interruption of the communication between the input port 208 and the output port 209, and the establishment of the communication between the port 212 and the output port 209 may be attained in a very reliable manner by the displacement of the first, second, and third valve elements 229, 222 and 221 and the small valve element 227 movably mounted on the third valve element 222. There is no erratic operation, and a long service life is ensured.

The negative pressure vs. temperature characteristics of the fourth embodiment are shown in FIG. 8, where the lower setting point is 60° C whereas the higher setting point is 95° or 100° C.

Figure 16:
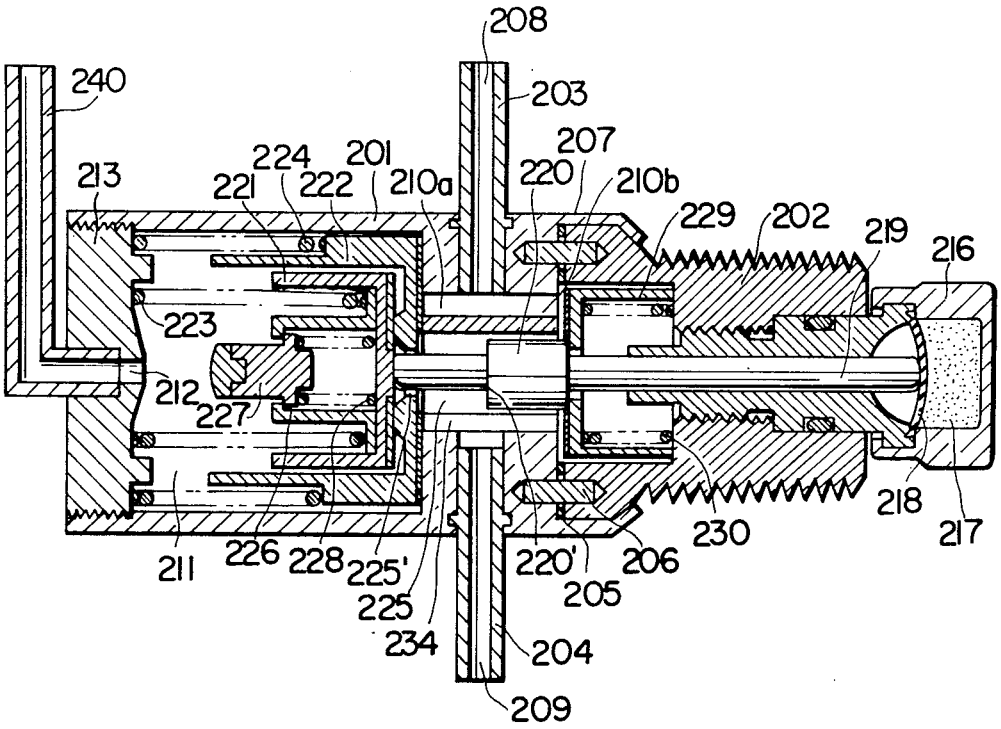
FIG. 16 is a sectional view of a variation of the thermostatic valve shown in FIGS. 13–15.

Variation, FIG. 16

The variation shown in FIG. 16 is substantially similar in consturction to the fourth embodiment shown in FIGS. 13–15 except that a pipe 240 is fitted to the air intake port 212 of the bottom plate 213 and the cap member is eliminated. The thermostatic valve of the type shown in FIG. 16 is used when the engine room is such that it is not preferable to induce the air surrounding the thermostatic valve into it. This thermostatic valve may be used in such a manner that the port 208 may be communicated with the surrounding atmosphere whereas the port 212 and hence the pipe 240 are communicated with a negative pressure source. So far the thermostatic valves of the present invention have been described as being used in a pneumatic system, but it is to be understood that they may be also used in a liquid system.

In the second, third, and fourth embodiments, the air inlet port 212 has been as closed by the movable small valve element 227 while it compresses the spring 228, but it is to be understood that the valve element 227 may be made of elastic material and securely fixed to the third valve element 221. Furthermore it is to be understood that the driving member 220 and the piston 219 may be made integral.

It will be understood that the fourth embodiment including its variation may be used as a three-way valve.

What is claimed is:

1. An ignition timing control device for an engine having a carburetor therein comprising:

a vacuum advance mechanism capable of controlling the ignition timing in response to a negative pressure in a carburetor, a negative pressure line communicating between said vacuum advance mechanism and said carburetor, and a thermostatic valve means for communicating said negative pressure line with the surrounding atmosphere only when the engine temperature is within a predetermined temperature range between a lower setting point and a higher setting point, said thermostatic valve including a valve casing having a valve bore, a chamber axially aligned with said bore and in constant communicating relationship with said negative pressure line, a first port provided coaxially on one end of said bore for intercommunicating said bore and said chamber and a second port provided coaxially on the other end of said bore and in constant communicating relationship with the surrounding atmosphere, a main valve element movably disposed in said bore with a substantial clearance therebetween, a first spring for urging said main valve element toward said first port, a second valve element coaxially and movably mounted on said main valve element, a second spring for urging said second valve element to a position projecting from said main valve element toward said second port, a temperature detector, and a piston rod extending from said detector through said chamber and said first port with a substantial clearance therebetween for moving said main valve element against said first spring in response to said temperature detector, wherein said main valve element closes said first port when the temperature of cooling water is less than said lower setting point and said second valve element closes said second port when the temperature of said cooling water is in excess of said higher setting point.

2. An ignition timing control device for an engine having a carburetor therein comprising;

a vacuum advance mechanism capable of controlling the ignition timing in response to a negative pressure in a carburetor, a negative pressure line communicating between said vacuum advance mechanism and said carburetor, and a thermostatic valve means for communicating said negative pressure line with the surrounding atmosphere only when the engine temperature is within a predetermined temperature range between a lower setting point and a higher setting point, said thermostatic valve including a valve casing having a cylindrical bore communicating with the surrounding air, an input port in communication with said carburetor, an output port in communication with said vacuum advance mechanism, a valve port opening to said bore and in communication with said input and output ports, said valve port having an annular groove formed in the inner wall of said cylindrical bore, and a valve element slidably fitted into said bore of said valve casing and movable in response to the thermal expansion of a substance therein so as to close said valve port only when the temperature of said cooling water is within said predetermined temperature range, said valve element being a hollow cup-shaped cylinder having a port formed through the side wall thereof and being adapted to coincide with said annular groove only when the temperature of said cooling water is within said predetermined range.

3. An ignition timing control device as defined in claim 2 wherein said bore is in communication with the surrounding atmosphere through an orifice for controlling the flow rate of air flowing into said thermostatic valve.

4. An ignition timing control device as defined in claim 2 wherein said valve element has an additional valve member which is so disposed as to move relative to said valve element, thereby closing said second port.

5. An ignition timing control device for an engine having a carburetor therein comprising:

a vacuum advance mechanism capable of controlling the ignition timing in response to a negative pressure in a carburetor, a negative pressure line communicating between said vacuum advance mechanism and said carburetor, and a thermostatic valve means for communicating said negative pressure line with the surrounding atmosphere only when the engine temperature is within a predetermined temperature range between a lower setting point and a higher setting point, said thermostatic valve means including a valve casing having a first and second bore spaced apart from one another in the axial direction, an input port in communication with said carburetor, an output port in communication with said vacuum advance mechanism, a first inlet port opening to said first bore and in communication with said input port, a first outlet port opening to said first bore and in communication with said output port, a second inlet port opening to one end of said second bore and in communication with said input port, a second outlet port opening to one end of said second bore and in communication with said output port, a third port opening to the other end of said second bore and in communication with the surrounding atmosphere, a first valve element slidably fitted in said first bore and operatively coupled to a temperature detector through a piston so as to close simultaneously both of said first inlet and outlet ports of said first bore in response to the thermal expansion of a substance only when the temperature of cooling water is at and above the lowest setting point, a second valve element slidably fitted in said second bore and operatively coupled to said temperature detector through said piston so as to open said second inlet port only when the temperature of cooling water is above said higher setting point, and a third valve element slidably fitted into said second bore and operatively coupled to said temperature detector through said piston so as to close said second outlet port when the temperature of cooling water is less than said lower setting point, to open said second outlet port and said third port when the temperature is within said temperature range, and to close said third port when the temperature is above said higher setting point.

6. An ignition timing control device as defined in claim 5 wherein said second valve element has an opening which normally communicates said second outlet port with second bore; and said third valve element is so arranged as to open or close said opening and has an additional valve element which is adapted to move over a limited distance relative to said third valve so as to open and close said third port.

* * * * *